US012172687B2

(12) United States Patent
Chen et al.

(10) Patent No.: US 12,172,687 B2
(45) Date of Patent: Dec. 24, 2024

(54) TEMPORARY TRAIN SPEED RESTRICTION MANAGEMENT METHOD AND SYSTEM

(71) Applicant: CASCO SIGNAL CO., LTD., Shanghai (CN)

(72) Inventors: Jin Chen, Shanghai (CN); Hui Zuo, Shanghai (CN); Xiang Chen, Shanghai (CN); Tingkai Xia, Shanghai (CN)

(73) Assignee: CASCO SIGNAL CO., LTD., Shanghai (CN)

( * ) Notice: Subject to any disclaimer, the term of this patent is extended or adjusted under 35 U.S.C. 154(b) by 231 days.

(21) Appl. No.: 17/793,167

(22) PCT Filed: Sep. 18, 2021

(86) PCT No.: PCT/CN2021/119229
§ 371 (c)(1),
(2) Date: Jul. 15, 2022

(87) PCT Pub. No.: WO2022/142495
PCT Pub. Date: Jul. 7, 2022

(65) Prior Publication Data

US 2023/0058661 A1 Feb. 23, 2023

(30) Foreign Application Priority Data

Dec. 31, 2020 (CN) ..... 202011617521.3

(51) Int. Cl.
*B61L 27/04* (2006.01)
*B61L 27/70* (2022.01)

(52) U.S. Cl.
CPC ..... *B61L 27/04* (2013.01); *B61L 27/70* (2022.01)

(58) Field of Classification Search
CPC ..... B61L 27/04; B61L 27/70
See application file for complete search history.

(56) References Cited

U.S. PATENT DOCUMENTS

2012/0323411 A1* 12/2012 Whitwam ..... B61L 23/00 701/19
2015/0060608 A1* 3/2015 Carlson ..... B61L 25/021 246/122 R (Continued)

FOREIGN PATENT DOCUMENTS

CN 103707904 A * 4/2014
CN 104354727 A 2/2015

(Continued)

OTHER PUBLICATIONS

Written Opinion issued to Application No. PCT/CN2021/119229 dated Dec. 28, 2021.

(Continued)

*Primary Examiner* — George C Jin
(74) *Attorney, Agent, or Firm* — Amster, Rothstein & Ebenstein LLP

(57) ABSTRACT

A temporary train speed restriction management method and system. Temporary speed restriction instructions are managed by adopting a uniform session management framework. The temporary speed restriction instructions in a session are uniformly processed in a session closing stage. The availability of a communication link is detected. The method and system performs life cycle management on the temporary speed restriction instructions by adding a timeliness mechanism for the message.

18 Claims, 4 Drawing Sheets

(56) References Cited

U.S. PATENT DOCUMENTS

| | | | | |
|---|---|---|---|---|
| 2015/0291193 | A1* | 10/2015 | Perras | G01S 19/14 246/122 R |
| 2022/0289259 | A1* | 9/2022 | Indre | B61L 27/40 |

FOREIGN PATENT DOCUMENTS

| | | | |
|---|---|---|---|
| CN | 104724142 | A | 6/2015 |
| CN | 104932925 | A | 9/2015 |
| CN | 105383520 | A | 3/2016 |
| CN | 106515796 | A | 3/2017 |
| CN | 106560373 | A | 4/2017 |
| CN | 110949460 | A | 4/2020 |
| CN | 111169509 | A | 5/2020 |
| CN | 111232025 | A | 6/2020 |
| CN | 112678027 | A | 4/2021 |
| EP | 2374687 | A2 | 10/2011 |
| JP | 2007230257 | A | 9/2007 |
| KR | 20160140772 | A | 12/2016 |

OTHER PUBLICATIONS

International Search Report issued to Application No. PCT/CN2021/119229 dated Dec. 28, 2021.

China National Intellectual Property Administration, Search Report for China Patent Application No. 202011617521.3, Feb. 28, 2022, 3 pp., China.

* cited by examiner

TEMPORARY TRAIN SPEED RESTRICTION MANAGEMENT METHOD AND SYSTEM

CROSS-REFERENCE TO RELATED APPLICATIONS

This application is a U.S. national stage entry under 35 U.S.C. § 371 of PCT International Patent Application No. PCT/CN2021/119229, filed Sep. 18, 2021, which claims priority to Chinese Patent Application No. 202011617521.3, filed Dec. 31, 2020, the contents of each of which are incorporated herein by reference in their entirety.

FIELD OF TECHNOLOGY

The present invention relates to the technical field of rail traffic signal safety, in particular to a temporary train speed restriction management method.

BACKGROUND

An automatic train monitoring system, a data storage unit and a regional controller are core parts of temporary train speed restriction. A basic thought of the temporary train speed restriction method is as follows: the automatic train monitoring system is responsible for man-machine interaction to issue a temporary speed restriction instruction to the data storage unit, where the temporary speed restriction instruction includes a speed restriction section position and a speed restriction speed; the data storage unit is responsible for storing and managing the temporary speed restriction instructions uniformly; and the regional controller requires temporary speed restriction information of a rail section within the jurisdiction to the data storage unit and generates a control message of a train and issues the control message to the train.

In actual operation, following conditions may exist:

1. The temporary speed restriction instructions are managed when the system is initialized;
2. The temporary speed restriction instructions are updated, where update operation includes setting a new temporary speed restriction instruction and canceling an existing temporary speed restriction instruction;
3. The regional controller in operation is restarted; and
4. The data storage unit is restarted in operation.

In the above scenes, as the system does not enter a working state completely, in order to guarantee safe operation of the train, the system only allows the train to operate in a minimum matched speed state. If the temporary speed restriction setting in the previous stage is restored from a database, the system cannot guarantee that the restored temporary speed restriction instruction is verified manually. An updated temporary speed restriction instruction coverage rail section may be located in different regional controller coverage sections, so that there is a synchronization problem of consistency of instructions of multi-regional controllers. During operation, as a result of network problem, a temporary disconnection problem as the temporary speed restriction request information sent by the regional controller is not correctively received by the data storage unit or a reply message of the data storage unit loses packets is caused. The data storage unit is to be in communication disconnection with the restarted regional controller, and at the time, the temporary speed restriction instruction cannot be synchronized to the regional controller, and there are a problem whether the temporary speed restriction instruction allows opened setting or not and a problem of detecting communication validity of the regional controller and the data storage unit. The regional controller cannot obtain a synchronized temporary speed restriction control message from the data storage unit being restarted, and the regional controller faces a timeliness management problem of the temporary speed restriction control message.

SUMMARY

The objective of the present invention is to provide a temporary train speed restriction management method, where the consistency of the temporary speed restriction instructions of the cross-regional controller and the timeliness coordination mechanism in each stage during temporary speed restriction instruction management are guaranteed by managing the temporary speed restriction instructions.

In order to achieve the objective, the present invention provides a temporary train speed restriction management method. A communication session is established between an automatic train monitoring system and a data storage unit, and the automatic train monitoring system issues a temporary speed restriction instruction to the data storage unit after the communication session is opened and in a closing process of the communication session, the data storage unit updates the temporary speed restriction instruction; a regional controller sends a temporary speed restriction information request periodically to the data storage unit, and the data storage unit prohibits replying to the temporary speed restriction information request of the regional controller during the updating of the data storage unit; and the data storage unit allows replying to the temporary speed restriction information request of the regional controller after the updating the data storage unit is completed.

The data storage unit includes a permanent storage area for the temporary speed restriction instruction and a temporary speed restriction instruction temporary storage area, where the permanent storage area for the temporary speed restriction instruction is used for storing the temporary speed restriction instruction after the data storage unit updates the temporary speed restriction instruction successfully, data in the permanent storage area for the temporary speed restriction instruction being synchronized to a system database, and the temporary storage area for the temporary speed restriction instruction is used for temporarily storing the temporary speed restriction instruction received during the communication session.

The temporary speed restriction instruction at least includes coordinates of head and tail rail sections of a speed restriction section, rail section identifiers comprised in the speed restriction section and a speed restriction rate.

The temporary speed restriction instruction includes the following types: setting a temporary speed restriction and canceling the temporary speed restriction, wherein the speed restriction rate of canceling the temporary speed restriction is 0.

The data storage unit generates a temporary speed restriction information reply message according to the temporary speed restriction instruction stored in the permanent storage area for the temporary speed restriction instruction so as to reply to the temporary speed restriction information request of the regional controller, wherein the regional controller applies the temporary speed restriction information in the temporary speed restriction information reply message to a corresponding rail section after receiving the temporary speed restriction information reply message.

A generation rule of the temporary speed restriction information reply message includes: mapping a temporary speed restriction area to the corresponding rail section according to the coordinates of the temporary speed restriction instruction, where the speed is set as a speed restriction value, and with regard to the rail section without the temporary speed restriction, the speed is set as the maximum design speed for the rail section.

The method of updating the temporary speed restriction instruction by the data storage unit includes: calculating a regional controller list needed to synchronize the temporary speed restriction instruction by the data storage unit, generating a temporary speed restriction update request by the data storage unit and sending the temporary speed restriction update request to a corresponding regional controller, and starting an update timer by the data storage unit simultaneously; and the regional controller sends a temporary speed restriction update reply to the date storage unit after receiving the valid temporary speed restriction update request; and if the data storage unit receives the temporary speed restriction update replies sent by all related regional controllers during a counting time of the update timer of the data storage unit, the data storage unit updates the temporary speed restriction instruction successfully and stores the updated temporary speed restriction instruction to the permanent storage area for the temporary speed restriction instruction.

After the update timer of the data storage unit is overtime, if the data storage unit has not received the temporary speed restriction update replies sent by all related regional controllers, it is failed to close the communication session.

The counting time of the update timer of the data storage unit is longer than or equal to two folds of a total time consumed by the data storage unit to send the temporary speed restriction update request and by the regional controller to send the temporary speed restriction update reply message.

The data storage unit starts a session timer after the communication session is successfully established between the automatic train monitoring system and the data storage unit, and after the session timer is overtime, the data storage unit fails to close the communication session, and the data storage unit closes the communication session automatically and refreshes data in the temporary speed restriction instruction temporary area as an invalid initial value.

The counting time of the session timer of the data storage unit shall guarantee the longest time consumed by the automatic train monitoring system end to execute a normal temporary speed restriction command operation.

The regional controller starts the update timer while sending the temporary speed restriction update reply, and after the update timer of the regional controller is overtime, if the regional controller has not received the valid temporary speed restriction information reply message sent by the data storage unit, temporary speed restrictions on all the rail sections within a scope of jurisdiction of the regional controller are set as an initialized temporary speed restriction speed.

The counting time of the update timer of the regional controller is longer than or equal to two folds of a period in which the regional controller sends the temporary speed restriction information request, and the counting time of the update timer of the regional controller is longer than the counting time of the update timer of the data storage unit.

When the data storage unit is powered on, the data storage unit is set to be in a state where the initialization of the temporary speed restriction instruction is not relieved, and the regional controller is unable to acquire valid temporary speed restriction information from the data storage unit.

After the data storage unit is powered on, the communication session is established between the automatic train monitoring system and the data storage unit; after the communication session is opened, the automatic train monitoring system issues a temporary speed restriction initialization relieving request to the data storage unit to relieve the initialized state of the data storage unit; and after the communication session is closed, the regional controller is allowed to acquire the temporary speed restriction information from the data storage unit.

After the data storage unit is powered on, the temporary speed restriction instruction which is valid before the data storage unit is powered on is refreshed from the system database to the permanent storage area for the temporary speed restriction instruction.

After the regional controller is powered on, the temporary speed restriction of the rail section within the jurisdiction is set as an initialized temporary speed restriction speed.

The automatic train monitoring system establishes a communication session with the data storage unit via an HILC protocol and operates a temporary speed restriction command.

The regional controller periodically sends an edition information request to the data storage unit; a valid communication timer is started after the data storage unit receives the edition information request; and after the valid communication timer is overtime, if the data storage unit has not received the temporary speed restriction update reply sent by the regional controller which sends the edition information request, the data storage unit declines the currently issued temporary speed restriction instruction.

The counting time of the valid communication timer is two folds of the period in which the regional controller sends the temporary speed restriction information request.

The regional controller starts a valid temporary speed restriction information timer while receiving the temporary speed restriction information reply message sent by the data storage unit, and after the valid temporary speed restriction information timer is overtime, if the regional controller has not received a new temporary speed restriction information reply message sent by the data storage unit, temporary speed restrictions on all the rail sections within the scope of jurisdiction of the regional controller are set as the initialized temporary speed restriction speed.

The initialized temporary speed restriction speed is a minimum matched speed of a route.

The present invention further provides an automatic train monitoring system, where the automatic train monitoring system establishes a communication session with a data storage unit, and after the communication session is opened, the automatic train monitoring system issues a temporary speed restriction instruction to the data storage unit.

The automatic train monitoring system establishes a communication session with the data storage unit via an HILC protocol and operates a temporary speed restriction command.

After the communication session is opened, the automatic train monitoring system issues a temporary speed restriction initialization relieving request to the data storage unit to relieve an initialized state of the data storage unit.

The present invention further provides a data storage unit, where after the communication session with the automatic train monitoring system is opened, the data storage unit receives a temporary speed restriction instruction issued by the automatic train monitoring system; in a closing process of the communication session, the data storage unit updates the temporary speed restriction instruction; and during the updating of the data storage unit, the data storage unit prohibit replying to a temporary speed restriction information request sent by a regional controller; and after update is completed, the data storage unit allows replying to the temporary speed restriction information request sent by the regional controller.

The data storage unit includes a permanent storage area for the temporary speed restriction instruction and a temporary storage area for the temporary speed restriction instruction, where the permanent storage area for the temporary speed restriction instruction is used for storing the temporary speed restriction instruction after the data storage unit updates the temporary speed restriction instruction successfully, data in the permanent storage area for the temporary speed restriction instruction being synchronized to a system database, and the temporary storage area for the temporary speed restriction instruction is used for temporarily storing the temporary speed restriction instruction received during the communication session.

The data storage unit generates a temporary speed restriction information reply message according to the temporary speed restriction instruction stored in the permanent storage area for the temporary speed restriction instruction so as to reply to the temporary speed restriction information request of the regional controller.

The method of updating the temporary speed restriction instruction by the data storage unit includes: calculating a regional controller list needed to synchronize the temporary speed restriction instruction by the data storage unit, generating a temporary speed restriction update request by the data storage unit and sending the temporary speed restriction update request to a corresponding regional controller, and starting an update timer by the data storage unit simultaneously; and if the data storage unit receives the temporary speed restriction update replies sent by all related regional controllers during a counting time of the update timer of the data storage unit, the data storage unit updates the temporary speed restriction instruction successfully and stores the updated temporary speed restriction instruction to the permanent storage area for the temporary speed restriction instruction.

After the update timer of the data storage unit is overtime, if the data storage unit has not received the temporary speed restriction update replies sent by all related regional controllers, it is failed to close the communication session.

The counting time of the update timer of the data storage unit is longer than or equal to two folds of a total time consumed by the data storage unit to send the temporary speed restriction update request and by the regional controller to send the temporary speed restriction update reply message.

The data storage unit starts a session timer after the communication session is successfully established between the automatic train monitoring system and the data storage unit, and after the session timer is overtime, the data storage unit fails to close the communication session, and the data storage unit closes the communication session automatically and refreshes data in the temporary speed restriction instruction temporary area as an invalid initial value.

The counting time of the session timer of the data storage unit shall guarantee the longest time consumed by the automatic train monitoring system to execute a normal temporary speed restriction command operation.

When the data storage unit is powered on, the data storage unit is set to be in a state where the initialization of the temporary speed restriction instruction is not relieved, and the regional controller is unable to acquire valid temporary speed restriction information from the data storage unit.

After the data storage unit is powered on, the communication session is established between the data storage unit and the automatic train monitoring system; after the communication session is opened, the data storage unit receives a temporary speed restriction initialization relieving request issued by the automatic train monitoring system to relieve the initialized state of the data storage unit; and after the communication session is closed, the regional controller is allowed to acquire the temporary speed restriction information from the data storage unit.

After the data storage unit is powered on, the temporary speed restriction instruction which is valid before the data storage unit is powered on from the system database to the permanent storage area for the temporary speed restriction instruction.

The valid communication timer is started after the data storage unit receives the edition information request sent by the regional controller; and after the valid communication timer is overtime, if the data storage unit has not received the temporary speed restriction update reply sent by the regional controller which sends the edition information request, the data storage unit declines the currently issued temporary speed restriction instruction.

The counting time of the valid communication timer is two folds of the period in which the regional controller sends the temporary speed restriction information request.

The present invention further provides a regional controller, where the regional controller periodically sends a temporary speed restriction information request to the data storage unit, and the regional controller applies the temporary speed restriction information in the temporary speed restriction information replay message after receiving the temporary speed restriction information reply message.

The regional controller sends a temporary speed restriction update replay to the date storage unit after receiving the temporary speed restriction update request.

The regional controller starts the update timer while sending the temporary speed restriction update reply, and after the update timer of the regional controller is overtime, if the regional controller has not received the temporary speed restriction information reply message sent by the data storage unit, temporary speed restrictions on all the rail sections within a scope of jurisdiction of the regional controller are set as an initialized temporary speed restriction speed.

The counting time of the update timer of the regional controller is longer than or equal to two folds of a period in which the regional controller sends the temporary speed restriction information request, and the counting time of the update timer of the regional controller is longer than the counting time of the update timer of the data storage unit.

After the regional controller is powered on, the temporary speed restriction of the rail section within the jurisdiction is set as an initialized temporary speed restriction speed.

The regional controller periodically sends an edition information request to the date storage unit.

The regional controller starts a valid temporary speed restriction information timer while receiving the temporary speed restriction information reply message sent by the data storage unit, and after the valid temporary speed restriction information timer is overtime, if the regional controller has not received a new temporary speed restriction information reply message sent by the data storage unit, temporary speed restrictions on all the rail sections within the scope of jurisdiction of the regional controller are set as the initialized temporary speed restriction speed.

The present invention further provides a temporary train speed restriction management system, where the temporary train speed restriction management system includes the automatic train monitoring system, the data storage unit and the regional controller.

According to the present invention, temporary speed restriction instructions are managed by adopting a uniform session management framework. By uniformly processing the temporary speed restriction instructions in a session in a session closing stage, it is guaranteed that the temporary speed restriction instructions of a cross-regional controller take effect consistently, so that disorder of a system that processes the temporary speed restriction instructions is avoided. By detecting the availability of a communication link, the present invention improves the availability and the fault tolerance of the system that processes the temporary speed restriction instructions. The present invention performs life cycle management on the temporary speed restriction instructions by means of adding a timeliness mechanism for the message, so that it is guaranteed that a train operates safely when a system assembly fails, and therefore, the availability of the system is improved.

DETAILED DESCRIPTION OF THE EMBODIMENTS

Figure 1:
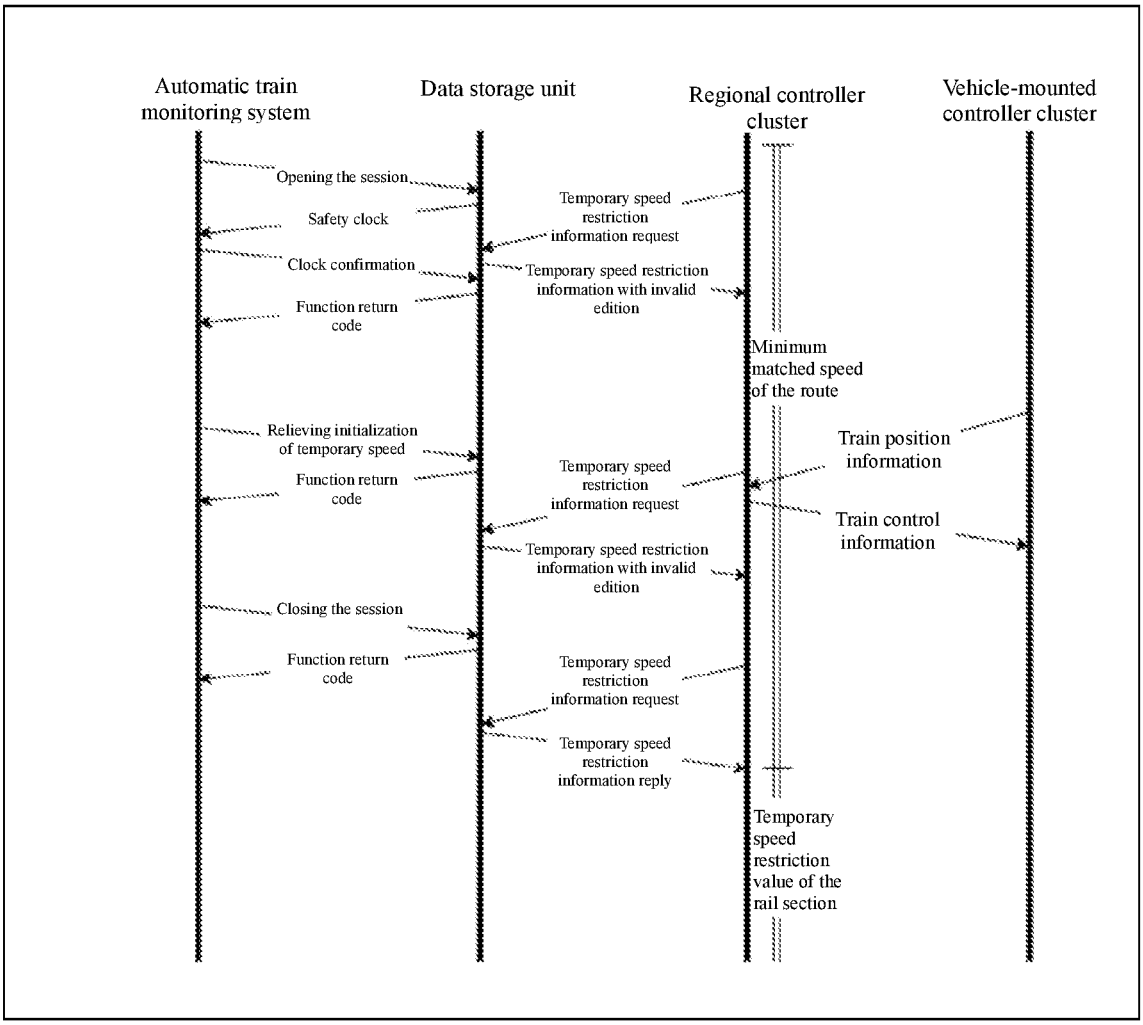
FIG. 1 is a temporary speed restriction processing flow when the system is initialized.

Preferred embodiments of the present invention are described specifically below according to FIG. 1 to FIG. 4.

The present invention aims to provide a temporary speed restriction processing method when the system initializes temporary speed restriction, the temporary speed restriction instruction is updated, the regional controller is restarted and the data storage unit is restarted. By means of the method, the consistency problem of synchronization of the temporary speed restriction instructions of the cross-regional controller and the management problem in a temporary speed restriction instruction life cycle in stages such as system initialization, assembly restart and instruction update are solved. The present invention solves response disorder of control messages of temporary train speed restriction caused by the above problems under a session management mechanism by designing a temporary speed restriction management method for initializing temporary speed restriction relieving confirmation, communication verification and timeliness coordination.

The present invention provides a temporary train speed restriction management method, including establishing a communication session between an automatic train monitoring system and a data storage unit to manage temporary speed restriction instructions.

On the one hand, when the system is initialized, the data storage unit is set to be in a state where the initialization of the temporary speed restriction instruction is not relieved, and the regional controller is unable to acquire valid temporary speed restriction information from the data storage unit, and the regional controller sets temporary speed restrictions on the rail section within jurisdiction as an initialized temporary speed restriction speed. After the communication session is opened, the automatic train monitoring system relieves the initialized state of the data storage unit, and after the communication session is closed, the regional controller is allowed to acquire the temporary speed restriction information from the data storage unit.

On the other hand, when the temporary speed restriction instruction is updated, the automatic train monitoring system issues the updated temporary speed restriction instruction to the data storage unit after the communication session is opened and in a closing process of the communication session, the data storage unit updates the temporary speed restriction instruction; the data storage unit prohibits replying to the temporary speed restriction information request of the regional controller during the updating of the data storage unit. The data storage unit allows replying to the temporary speed restriction information request of the regional controller after updating the temporary speed restriction instruction successfully.

The method of updating the temporary speed restriction instruction by the data storage unit includes: the data storage unit calculates a regional controller list needed to synchronize the temporary speed restriction instruction; the data storage unit generates a temporary speed restriction update request and sends the temporary speed restriction update request to a corresponding regional controller, and the data storage unit starts an update timer by simultaneously; the regional controller sends a temporary speed restriction update reply to the date storage unit after receiving the temporary speed restriction update request; and if the data storage unit receives the temporary speed restriction update replies sent by all related regional controllers during a counting time of the update timer of the data storage unit, the data storage unit updates the temporary speed restriction instruction successfully and stores the updated temporary speed restriction instruction to the permanent storage area for the temporary speed restriction instruction.

FIG. 1 is a flow diagram of system initialization. The data storage unit is used for storing the temporary speed restriction instructions issued by the automatic train monitoring system and coordinating and managing a temporary speed restriction information request of the regional controller. The data storage unit divides the memory into a permanent storage area for the temporary speed restriction instruction and a temporary storage area for the temporary speed restriction instruction during the session in software view, and when data stored in the permanent storage area for the temporary speed restriction instruction changes, the data is synchronized to a hardware platform database. After the data storage unit is powered on, whether the temporary speed restriction instruction stored in the database is loaded to the permanent storage area for the temporary speed restriction instruction or not is decided according to whether a configuration field with a memory restoring function is applied to configuration data or not. The configuration data is a driving configuration loaded after the data storage unit is powered on. The memory restoring function is controlled by using a Boolean switching value. When the Boolean switching value is configured to be true, the temporary speed restriction instruction stored in the platform database is loaded after being powered on and otherwise, the temporary speed restriction instruction is not loaded. After initialization, the data storage unit is in the stage that initialization of the temporary speed restriction instruction is not relieved.

After the regional controller is powered on, the temporary speed restriction of the rail section within the jurisdiction is set as an initialized temporary speed restriction speed. In the configuration data of the regional controller, the speed value is usually the minimum matched speed of the route. The regional controller sends the temporary speed restriction information request to the data storage unit to acquire the temporary speed restriction information on the rail section within the jurisdiction in the current region. When the data storage unit is still in the stage that initialization of the temporary speed restriction instruction is not relieved, the regional controller sends the temporary speed restriction information request to the data storage unit so as to obtain the temporary speed restriction information reply message containing an invalid edition. The temporary speed restriction information in the message is not applied to the rail section by the regional controller, where the edition information in the reply information is used for differentiating validness of the reply message. When the reply information contains the invalid edition information, the regional controller uses the current internal valid temporary speed restriction and ignores the reply information.

Initialization limit to the temporary speed restriction instruction by the system is relieved. An operator issues a session opening instruction to the data storage unit via the automatic train monitoring system. Session management adopts the HILC protocol. When the automatic train monitoring system receives a return message that the session sent by the data storage unit is opened correctively, the automatic train monitoring system end issues a temporary speed restriction initialization relieving instruction to the data storage unit to relieve limit to the temporary speed restriction operation by the system. The HILC protocol is a dedicated protocol for communication between a safety device and a non-safety device. The protocol guarantees communication safety by way of secondary confirmation. First of all, a sending terminal sends a request to a receiving terminal. The receiving terminal sends a safety clock message to the sending terminal after receiving the request to confirm validness of the request. The receiving terminal starts to respond to the initial request of the sending terminal after receiving a clock confirming request of the sending terminal within a stipulated time and sends a corresponding function return code to the sending terminal according to a response result (succeed/fail). The data storage unit returns a correct relieving return message to the automatic train monitoring system after successfully relieving initialization restriction of the temporary speed restriction instruction. Finally, the automatic train monitoring system end sends the session closing request to the data storage unit, and the data storage unit returns a correct closing return message to the automatic train monitoring system. After the session is closed successfully, the regional controller end sends the temporary speed restriction information request to the data storage unit periodically, and the data storage unit generates the reply message according to the temporary speed restriction instruction stored in the permanent storage area for the temporary speed restriction instruction. A generation rule of the reply message is as follows: a temporary speed restriction area is mapped to the corresponding rail section according to the coordinates of the temporary speed restriction instruction, where the speed is set as a speed restriction value, and with regard to the rail section without the temporary speed restriction, the speed is set as the maximum design speed for the rail section. The regional controller applies the temporary speed restriction information in the reply message to the corresponding rail section after receiving the correct temporary speed restriction information reply message to relieve speed restriction of the initialized temporary speed restriction on the rail section.

Figure 2:
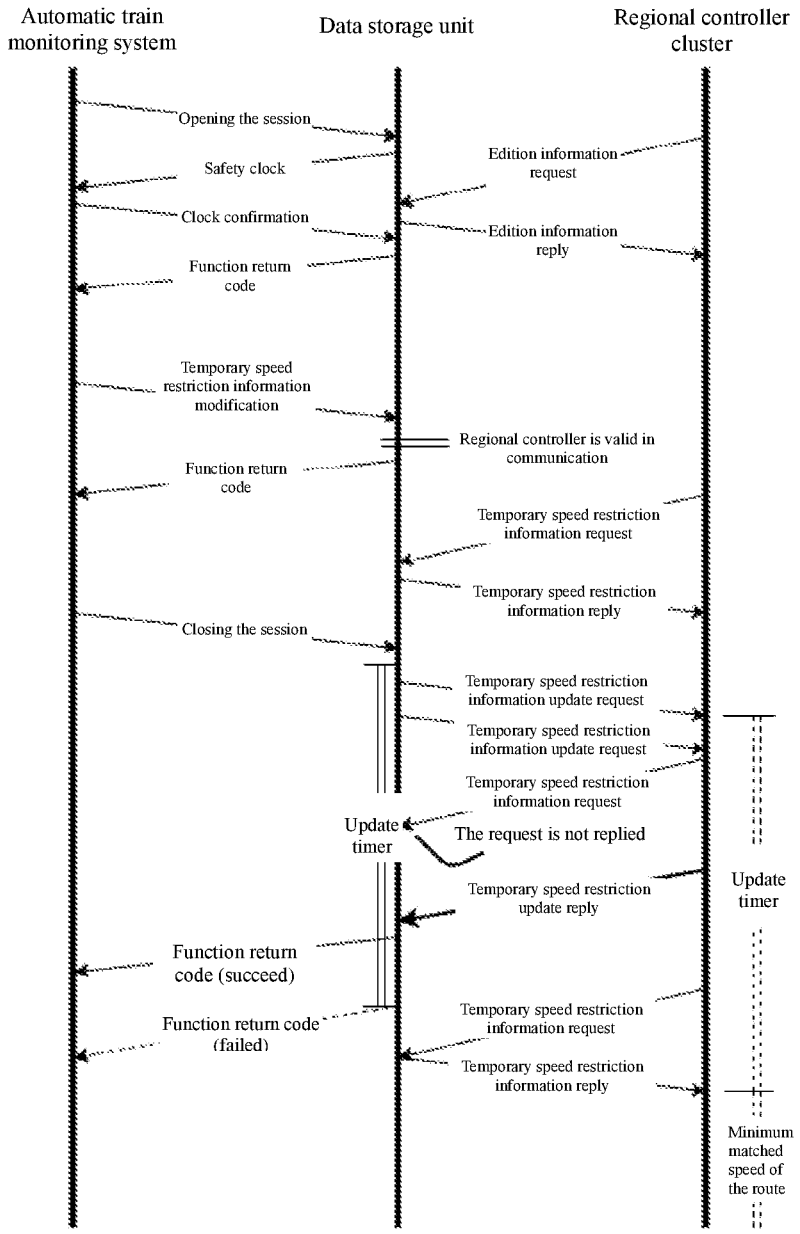
FIG. 2 is a temporary speed restriction instruction update processing flow.

FIG. 2 is a temporary speed restriction instruction update schematic diagram. First of all, the automatic train monitoring system opens the session to relieve restriction of the system on modification of the temporary speed restriction instruction by the automatic train monitoring system end. After the data storage unit opens the session successfully, the session timer is started to set a time-out period and start timing. Then the automatic train monitoring system sets the temporary speed restriction instruction and issues the temporary speed restriction instruction to the data storage unit. The intact temporary speed restriction instruction includes coordinates of head and tail rail sections of a speed restriction section, rail section identifiers comprised in the speed restriction section and a speed restriction rate. The temporary speed restriction instruction can include the following types: setting a temporary speed restriction and canceling the temporary speed restriction, where the rate of canceling the temporary speed restriction is 0.

If the temporary speed restriction instruction issued to the data storage unit is setting temporary speed restriction, the data storage unit examines whether the rate in the temporary speed restriction instruction is 0 or not first. If the rate is 0, it reports an error. Then the data storage unit then examines whether the communication connection between the regional controller in the temporary speed restriction section and the data storage unit is valid or not. If there are invalid communication links, the data storage unit abandons a set request and feeds unsuccessful setting back to the automatic train monitoring system. If communications are normal, the data storage unit examines whether the rail section within the speed restriction section in the temporary speed restriction instruction is continuous physically or not. If the rail section is discontinuous, the data storage unit reports an error. Otherwise, the data storage unit maps the temporary speed restriction section to the corresponding rail section. The data storage unit then examines whether there is an overlapped part between the mapping result and the existing temporary speed restriction section or not. If there is the overlapped part, the data storage unit abandons the request and feeds unsuccessful setting back to the automatic train monitoring system. Otherwise, the data storage unit updates the temporary speed restriction instruction on the rail section to the temporary storage area for the temporary speed restriction instruction and feeds successful setting back to the automatic train monitoring system.

If the temporary speed restriction instruction issued to the data storage unit is canceling the existing temporary speed restriction, the data storage unit verifies whether the speed in the temporary speed restriction instruction is 0 or not. If the speed is not 0, the data storage unit reports an error. Then the data storage unit performs section overlap examination to examine whether the speed restriction of the existing temporary speed restriction instruction is overlapped with a positive sequence or an inverted sequence of the speed restriction section in the current temporary speed restriction instruction or not. If the speed restriction of the existing temporary speed restriction instruction is not overlapped with the positive sequence or the inverted sequence of the speed restriction section in the current temporary speed restriction instruction, the data storage unit abandons the existing current request and feeds unsuccessful setting back to the automatic train monitoring system. If the speed restriction of the existing temporary speed restriction instruction is overlapped with the positive sequence or the inverted sequence of the speed restriction section in the current temporary speed restriction instruction, the data storage unit maps the current speed restriction instruction to the rail section and updates the corresponding data of the temporary storage area for the temporary speed restriction instruction with the mapping result.

In the session closing stage, the data storage unit verifies validity of the session closing request first to prevent message distortion of the session closing request due to communication abnormality and prevent the data storage unit from receiving the session closing request, not belonging to the data storage unit, sent by the automatic train monitoring system. If the session closing request is invalid, the data storage unit abandons the closing request. If the session closing request is valid, the data storage unit calculates a regional controller list needed to synchronize the temporary speed restriction instruction, generates a temporary speed restriction update request and sends the temporary speed restriction update request to a corresponding regional controller, starts a temporary speed restriction update timer at the end of the data storage unit to count down and waits for a temporary speed restriction update reply message sent by the regional controller. After receiving the valid temporary speed restriction update request, the regional controller starts the temporary speed restriction update timer at the end of the regional controller and sends temporary speed restriction update reply to the date storage unit simultaneously. At the end of the data storage unit, if the data storage unit receives all the temporary speed restriction update reply messages needed to synchronize the temporary speed restriction instruction and sent by the regional controller during a period that the temporary speed restriction update timer is not overtime, the data storage unit executes a session successful closing operation; if the temporary speed restriction update timer has been overtime and the data storage unit has not yet received the temporary speed restriction update messages replied by all the regional controller, the data storage unit executes a session closing failure operation: the temporary speed restriction instruction is not synchronized to the permanent storage area for the temporary speed restriction instruction. If the data storage unit has not executed the session successful closing operation in the period of validity of the session timer and the session timer is overtime, the data storage unit closes the session automatically and refreshes the data in the temporary storage area for the temporary speed restriction instruction to invalid initial values. At the end of the regional controller, if the regional controller has not yet received the valid temporary speed restriction information request reply message when the temporary speed update timer started by the regional controller is overtime, it is guided to the safety side to set the temporary speed restriction on all the rail sections in the scope of the regional controller within jurisdiction to be the initial value so as to restrict overspeed operation of the train on the rail sections. The relation among the abovementioned three timers is as follows: the counting time set by the session timer of the data storage unit is longer than the counting time set by the temporary speed restriction update timer of the regional controller, and the counting time set by the temporary speed restriction update timer of the regional controller is longer than the counting time set by the temporary speed restriction update timer of the data storage unit. In principle, the counting time set by the temporary speed restriction update counter of the data storage unit is longer than or equal to two folds of the maximum total time consumed by sending the temporary speed restriction update request and replying the temporary speed update reply message between the data storage unit and the regional controller, and the counting time set by the temporary speed restriction update counter of the regional controller is longer than or equal to two or more folds of the period in which the regional controller sends the temporary speed restriction information request. The counting time set by the temporary speed restriction update counter of the regional controller is longer than the counting time set by the temporary speed restriction update counter of the data storage unit, which aims to guarantee that the temporary speed restriction command is within the update period. The end of the regional controller has not set the temporary speed restriction of the route to be the minimum matched speed as a result of overtime accident of the temporary speed restriction update timer. The counting time of the session timer of the data storage unit is set to be maximum for smooth operation. In the session closing stage, the data storage unit enters the temporary speed restriction instruction update period after sending the temporary speed restriction update request. During the period, the data storage unit is prohibited to send the temporary speed restriction information request replay message to the regional controller and is refreshed to respond to the temporary speed information request sent by the regional controller till the session is closed. After the session is closed, the data storage unit replies to the received temporary speed restriction information request, calculates the temporary speed restriction information on the rail section and sends the temporary speed restriction information to the requested regional controller. If the update timer at the end of the regional controller has not yet received the valid temporary speed restriction information reply when the update timer is overtime after the session is closed, the regional controller sets the temporary speed restriction to be the minimum matched speed of the route.

Figure 3:
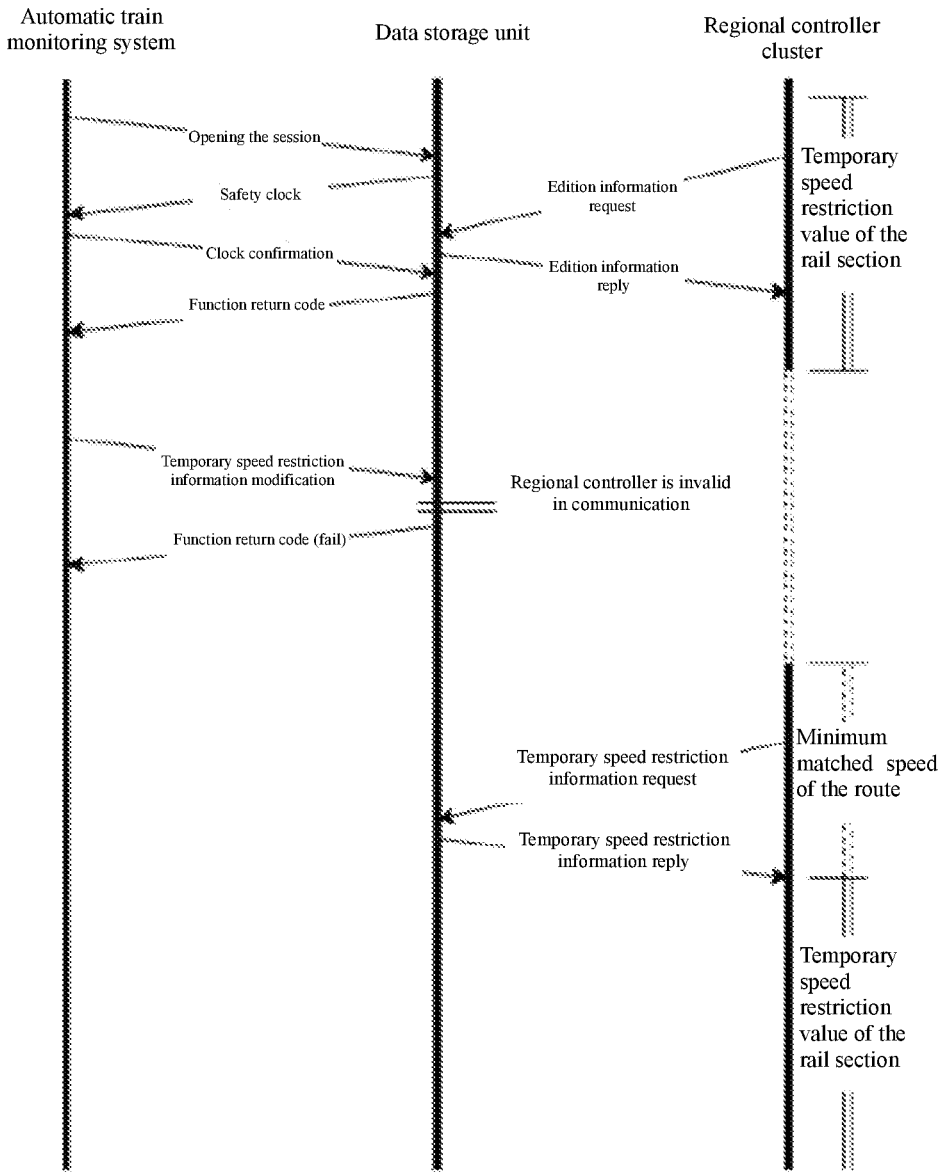
FIG. 3 is a temporary speed restriction processing flow when the regional controller is restarted during operation.

FIG. 3 is a temporary speed restriction processing schematic diagram when the regional controller is restarted during operation. The regional controller is in the restarted stage and is in disconnected communication with the data storage unit. The regional controller sends the edition information request periodically to the data storage unit prior to disconnection with the data storage unit, and the data storage unit starts the valid communication timer after receiving the edition information request. The edition information request plays a role of detecting whether communication between the regional controller and the data storage unit is normal or not in the aspect of temporary speed restriction management, so that the availability of the system is improved. The counting time set by the valid communication timer is two folds of the period in which the regional controller sends the temporary speed restriction information request. If the valid communication timer is not overtime in the restarting stage of the regional controller, the automatic train monitoring system issues the temporary speed restriction instruction to the data storage unit, where the temporary speed restriction instruction is to be updated to the temporary speed restriction instruction temporary area to wait for closing the session so as to perform closing operation. If the valid communication timer has been overtime in the restarting stage of the regional controller, the data storage unit declines the currently issued temporary speed restriction instruction and sends an operation failure instruction to the automatic train monitoring system.

When the session is closed in the scene that the valid communication timer is not overtime, the regional controller has been restarted, and a communication connection between the regional controller and the data storage unit has not been restored, so that the temporary speed restriction request sent by the data storage unit to the regional controller is unable to be replied. The data storage unit sends a function return code that it fails to close the session to the automatic train monitoring system after waiting for overtime of the temporary speed restriction update timer, and refreshes the speed restriction instruction in the temporary storage area for the temporary speed restriction instruction when waiting for overtime of the session timer.

When the session is closed in the scene that the valid communication timer is not overtime, the regional controller has been restarted, and a communication connection between the regional controller and the data storage unit has been restored, so that the temporary speed restriction request sent by the data storage unit to the regional controller is to be replied. The data storage unit synchronizes the temporary speed restriction instruction in the temporary storage area for the temporary speed restriction instruction to the permanent storage area first and finally relieves low speed restriction of the rail section by synchronizing the temporary speed restriction request to the regional controller after the regional controller is restarted.

Figure 4:
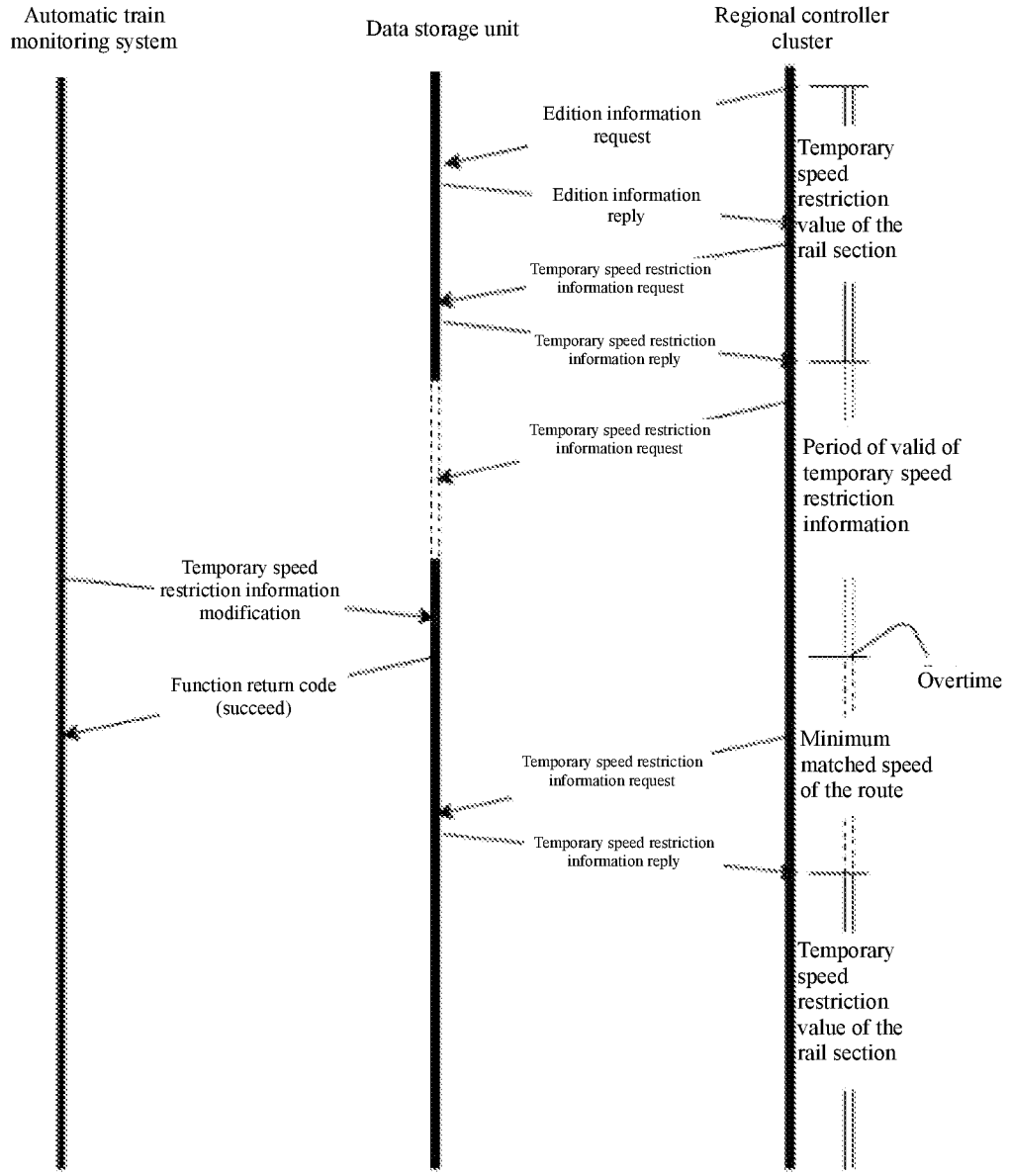
FIG. 4 is a temporary speed restriction processing flow when the data storage unit is restarted during operation.

FIG. 4 is a temporary speed restriction processing schematic diagram when the data storage unit is restarted during operation. The data storage unit is in the restarted stage, the regional controller loses the communication connection with the data storage unit (losing the communication connection here means that messages sent by one another cannot be processed as the regional controller and the data storage unit are offline), and the regional controller starts the valid temporary speed restriction timer based on the temporary speed restriction information reply message received successfully last time. The valid temporary speed restriction information reply message has a life cycle which shall be longer than the period of two temporary speed restriction information requests, and the valid temporary speed restriction information timer is the valid period timer corresponding set by the regional controller to manage the life cycle of each temporary speed restriction instruction and is a representative of the valid speed restriction instruction in the scope of the valid period. If the regional controller has not yet received the valid temporary speed restriction request replay message when the valid temporary speed restriction information timer is overtime, the existing temporary speed restriction instruction is overtime and invalid, and the regional controller sets the temporary speed restriction value of the rail section with the jurisdiction to be the initial speed restriction value, i.e., the minimum matched speed of the route, thereby, guaranteeing safe driving of the train. In the restarted stage of the data storage unit, if the data storage unit is configured with a memory restoration function, the temporary speed restriction instruction which is valid is refreshed from a database of a hardware platform to the permanent storage area for the temporary speed restriction instruction. After the restarting the data storage unit is completed, the automatic train monitoring system issues a temporary speed restriction initialization relieving request to the data storage unit. After the data storage unit relieves the initialized temporary speed restriction successfully, the data storage unit starts to reply the temporary speed restriction information request to the regional controller, and the regional controller updates the temporary speed restriction on the rail section according to the message content after receiving the valid temporary speed restriction information reply message.

According to the method of the present invention, the temporary speed restriction operation on the train is managed by means of "session management". After the session is opened, operation setting is allowed or temporary speed restriction of the train is canceled, and the altered temporary speed restriction instruction is stored in the session of the data storage unit. When the session is closed, the data storage unit sends the temporary speed restriction update request to the regional controller related to the temporary speed restriction instruction to detect whether communication is normal or not. When the data storage unit receives the valid detection response in an appointed time range, the data storage unit sets the temporary speed restriction instructions in the session to be in an applicable state uniformly so as to wait for the regional controller to require the temporary speed restriction information in the applicable state.

Compared with the prior art, the present invention has the advantages:

According to the present invention, the temporary speed restriction operation on the train is managed by means of "session management". After the session is opened, operation setting is allowed or temporary speed restriction of the train is canceled, and the altered temporary speed restriction instruction is stored in the session of the data storage unit. The data storage unit is prohibited to reply to the temporary speed restriction information request of the regional controller during updating the temporary speed restriction instruction, and the communication validity of the data storage unit and the regional controller related to the temporary speed restriction instruction is tested. The temporary speed restriction instructions in the session are uniformly set to be in the applicable state if the communication is valid to reply to the temporary speed restriction information request of the regional controller, so that the consistency of the temporary speed restriction instructions of the cross-regional controllers which take effect is guaranteed, and a condition that the intact temporary speed restriction instruction only takes effect on a part of regional controllers.

By introducing timeliness management of the temporary speed restriction instruction, the validity timer is set in each stage of management of the temporary speed restriction instruction to define an overtime processing mechanism which follows a fault-oriented safety principle, coordination for setting the temporary speed restriction instruction and the operation safety of the train are guaranteed.

It is to be noted that in the embodiments of the present invention, orientation or position relations indicated by the terms 'center', 'upper', 'lower', 'left', 'right', 'vertical', 'horizontal', 'inside', 'outside' and the like are orientation or position relations based on the drawings and are only used for convenient description of the embodiments rather than indicates or implies that the indicated devices or components must have specific orientations and are configured and operated in the specific orientations. Therefore, it cannot be construed as limitations to the present invention. In addition, the terms 'first', 'second' and 'third' are only used for a description purpose rather than being construed to indicate or imply relative importance.

Although the content of the present invention has been described in details through the above preferred embodiments, it should be realized that the above description should not be considered as limit to the present invention. Many modifications and variations of the present invention will be apparent to those skilled in the art who have read the above content. Therefore, the scope of the present invention shall be defined by the appended claims.

The invention claimed is:

1. A temporary train speed restriction management method, comprising:

establishing a communication session between an automatic train monitoring system and a data storage unit;

issuing, by the automatic train monitoring system, a temporary speed restriction instruction to the data storage unit after the communication session is opened;

updating, by the data storage unit, the temporary speed restriction instruction in a closing process of the communication session;

wherein the method of updating the temporary speed restriction instruction by the data storage unit comprises:

calculating a regional controller list needed to synchronize the temporary speed restriction instruction by the data storage unit;

generating a temporary speed restriction update request by the data storage unit and sending the temporary speed restriction update request to a corresponding regional controller, and starting an update timer by the data storage unit simultaneously;

sending, by the regional controller, a temporary speed restriction update reply to the date storage unit after receiving the temporary speed restriction update request; and if the data storage unit receives the temporary speed restriction update replies sent by all related regional controllers during a counting time of the update timer of the data storage unit, updating, by the data storage unit, the temporary speed restriction instruction successfully and storing the updated temporary speed restriction instruction to the permanent storage area for the temporary speed restriction instruction;

sending, by a regional controller, a temporary speed restriction information request periodically to the data storage unit, wherein the data storage unit prohibits replying to the temporary speed restriction information request of the regional controller during the updating of the data storage unit and the data storage unit allows replying to the temporary speed restriction information request of the regional controller after the updating the data storage unit is completed;

generating, by the data storage unit, a temporary speed restriction information reply message according to the temporary speed restriction instruction stored in the permanent storage area for the temporary speed restriction instruction so as to reply to the temporary speed restriction information request of the regional controller; and applying, by the regional controller, temporary speed restriction information in the temporary speed restriction information reply message to a corresponding rail section after receiving the temporary speed restriction information reply message, wherein the data storage unit comprises a permanent storage area for the temporary speed restriction instruction and a temporary storage area for the temporary speed restriction instruction, wherein the permanent storage area for the temporary speed restriction instruction is used for storing the temporary speed restriction instruction after the data storage unit updates the temporary speed restriction instruction successfully, data in the permanent storage area for the temporary speed restriction instruction being synchronized to a system database, and the temporary storage area for the temporary speed restriction instruction is used for temporarily storing the temporary speed restriction instruction received during the communication session;

wherein the data storage unit starts a session timer after the communication session is successfully established between the automatic train monitoring system and the data storage unit, and after the session timer is overtime, the data storage unit fails to close the communication session, and the data storage unit closes the communication session automatically and refreshes data in the temporary storage area for the temporary speed restriction instruction as an invalid initial value, wherein the regional controller starts the update timer while sending the temporary speed restriction update reply, and after the update timer of the regional controller is overtime, if the regional controller has not received the temporary speed restriction information reply message sent by the data storage unit, temporary speed restrictions on all the rail sections within a scope of jurisdiction of the regional controller are set as an initialized temporary speed restriction speed.

2. The temporary train speed restriction management method according to claim 1, wherein the temporary speed restriction instruction at least comprises coordinates of head and tail rail sections of a speed restriction section, rail section identifiers comprised in the speed restriction section, and a speed restriction rate.

3. The temporary train speed restriction management method according to claim 2, wherein the temporary speed restriction instruction comprises the following types: setting a temporary speed restriction and canceling the temporary speed restriction, wherein the speed.

4. The temporary train speed restriction management method according to claim 1, wherein a generation rule of the temporary speed restriction information reply message comprises: mapping a temporary speed restriction area to the corresponding rail section according to the coordinates of the temporary speed restriction instruction, wherein the speed is set as a speed restriction value, and with regard to the rail section without the temporary speed restriction, the speed is set as the maximum design speed for the rail section.

5. The temporary train speed restriction management method according to claim 1, wherein after the update timer of the data storage unit is overtime, if the data storage unit has not received the temporary speed restriction update replies sent by all related regional controllers, it fails to close the communication session.

6. The temporary train speed restriction management method according to claim 5, wherein the counting time of the update timer of the data storage unit is longer than or equal to twofold of a total time consumed by the data storage unit to send the temporary speed restriction update request and by the regional controller to send the temporary speed restriction update reply message.

7. The temporary train speed restriction management method according to claim 1, wherein the counting time of the session timer of the data storage unit shall guarantee the longest time consumed by the automatic train monitoring system to execute a normal temporary speed restriction command operation.

8. The temporary train speed restriction management method according to claim 1, wherein the counting time of the update timer of the regional controller is longer than or equal to twofold of a period in which the regional controller sends the temporary speed restriction information request, and the counting time of the update timer of the regional controller is longer than the counting time of the update timer of the data storage unit.

9. The temporary train speed restriction management method according to claim 1, wherein when the data storage unit is powered on, the data storage unit is set to be in a state where the initialization of the temporary speed restriction instruction is not relieved, and the regional controller is unable to acquire valid temporary speed restriction information from the data storage unit.

10. The temporary train speed restriction management method according to claim 9, further comprising:

after the data storage unit is powered on, establishing the communication session between the automatic train monitoring system and the data storage unit;

after the communication session is opened, issuing, by the automatic train monitoring system, a temporary speed restriction initialization relieving request to the data storage unit to relieve the initialized state of the data storage unit; and after the communication session is closed, allowing the regional controller to acquire the temporary speed restriction information from the data storage unit.

11. The temporary train speed restriction management method according to claim 10, wherein after the data storage unit is powered on, the temporary speed restriction instruction which is valid before the data storage unit is powered on is refreshed from the system database to the permanent storage area for the temporary speed restriction instruction.

12. The temporary train speed restriction management method according to claim 1, wherein after the regional controller is powered on, the temporary speed restriction of the rail section within the jurisdiction is set as an initialized temporary speed restriction speed.

13. The temporary train speed restriction management method according to claim 1, further comprising:

periodically sending, by the regional controller, an edition information request to the data storage unit;

starting a valid communication timer after the data storage unit receives the edition information request; and after the valid communication timer is overtime, if the data storage unit has not received the temporary speed restriction update reply sent by the regional controller which sends the edition information request, declining, by the data storage unit, the currently issued temporary speed restriction instruction.

14. The temporary train speed restriction management method according to claim 13, wherein the counting time of the valid communication timer is twofold of the period in which the regional controller sends the temporary speed restriction information request.

15. The temporary train speed restriction management method according to claim 1, further comprising:

starting, by the regional controller, a valid temporary speed restriction information timer while receiving the temporary speed restriction information reply message sent by the data storage unit; and after the valid temporary speed restriction information timer is overtime, if the regional controller has not received a new temporary speed restriction information reply message sent by the data storage unit, setting temporary speed restrictions on all the rail sections within the scope of jurisdiction of the regional controller as the initialized temporary speed restriction speed.

16. The temporary train speed restriction management method according to claim 1, wherein the initialized temporary speed restriction speed is the minimum matching speed of a route.

17. The temporary train speed restriction management method according to claim 12, wherein the initialized temporary speed restriction speed is the minimum matching speed of a route.

18. The temporary train speed restriction management method according to claim 15, wherein the initialized temporary speed restriction speed is the minimum matching speed of a route.

* * * * *